United States Patent [19]

Kerley

[11] Patent Number: 4,766,648

[45] Date of Patent: Aug. 30, 1988

[54] MODULE FEEDER

[76] Inventor: Donald J. Kerley, Box 66, Saragosa, Tex. 79780

[21] Appl. No.: 412,266

[22] Filed: Aug. 27, 1982

[51] Int. Cl.[4] ..... D01B 1/00

[52] U.S. Cl. ..... 19/80 R

[58] Field of Search ..... 19/80 R, 64.5

[56] References Cited

U.S. PATENT DOCUMENTS 2,970,782 2/1961 Fleissner ..... 19/80 R
2,989,252 6/1961 Babb ..... 19/80 R
3,051,398 8/1962 Babb ..... 19/80 R
4,109,875 8/1978 Condarco et al. ..... 19/80 R X

*Primary Examiner*—Louis K. Rimrodt
*Assistant Examiner*—J. L. Olds
*Attorney, Agent, or Firm*—Wendell Coffee

[57] ABSTRACT

A cotton module is laid or placed on a horizontal deck. The deck is tilted so the module slides across a short slide into a header where the module is broken and fed into a hopper. Feeders at the bottom of the hopper feed the cotton into the gin at a rate as needed by the cotton gin.

4 Claims, 2 Drawing Sheets

MODULE FEEDER

CROSS REFERENCE TO RELATED APPLICATIONS

None, however, applicant filed Disclosure Document No. 107,892 on Apr. 26, 1982 which document concerns this application; therefore, by separate paper it is respectfully requested that the document be retained and acknowledgement thereof made by the Examiner. (MoPEP 1706)

BACKGROUND OF THE INVENTION (1) Field of the Invention

This invention relates to cotton ginning and more particularly to feeding seed cotton from a packed module into a cotton gin.

(2) Description of the Prior Art

At the time of this invention, a majority of the seed cotton is packed in modules after being harvested. From the modules, it is picked up by a truck (which is a modification of that shown in SCHILTZ U.S. Pat. No. 3,298,550) and transported to a cotton gin. At the cotton gin, it is necessary to move the seed cotton from the module into the cotton gin for further processing. At some gins, the module is placed upon the ground under a suction pipe and moved into the cotton gin by suction.

WILKES ET AL, U.S. Pat. No. 3,897,018 shows a system for breaking the cotton up and moving it into a cotton gin. Other cotton feeder systems are shown in the CONDARCO ET AL U.S. Pat. No. 4,109,875 and the PRATHER patents, U.S. Pat. No. 4,214,347, U.S. Pat. No. 4,202,079, and U.S. Pat. No. 4,117,571. Basically the WILKES ET AL machine moves the module horizontally into a breaker by a conveyor mechanism. The CONDARCO and PRATHER machines move the breaker on tracks into the module.

The CONDARCO and PRATHER units are well-known and commercially available on the market.

Before this application was filed, applicant caused a search to be made in the United States Patent and Trademark Offfice. This search revealed the following U.S. Pat. Nos.:

| | |
|---|---|
| BABB | 2,989,252 |
| BABB | 3,051,398 |
| WILKES ET AL | 3,897,018 |
| RYAN | 3,926,378 |
| HARRELL ET AL | 3,963,111 |
| RYAN | 3,972,484 |
| HUSKY | 4,031,003 |
| SELONKE ET AL | 4,223,845 |

The HUSKY patent discloses a system for sliding a module from a carrier onto a conveyor where it is carried to a breaker.

The other patents do not appear to be of as much interest as those specifically cited above. However, they were brought to the attention of the Examiner inasmuch as the applicant believes they would be of interest to him since they were reported by an experienced patent searcher.

SUMMARY OF THE INVENTION (1) New and Different Function

I have invented a system for moving seed cotton packed in a module into a cotton gin, which eliminates the problem of a mechanical conveyor for moving the cotton into the breaker or mechanically moving the breaker to the cotton. Basically, according to my system, the seed cotton is placed on a horizontal deck from the truck carrying the module. The deck is then tilted, sliding the cotton into the breaker.

The cotton broken from the module is held in a hopper and fed from the hopper at a rate as needed by the cotton gin.

Thus it may be seen that the function of my total combination far exceeds the sum of the functions of the individual elements such as hydraulic cylinders, hinges, hoppers, etc.

(2) Objects of this Invention

An object of this invention is to feed seed cotton from a module into a cotton gin evenly according to the need of the cotton gin.

Further objects are to achieve the above with a device that is sturdy, compact, durable, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
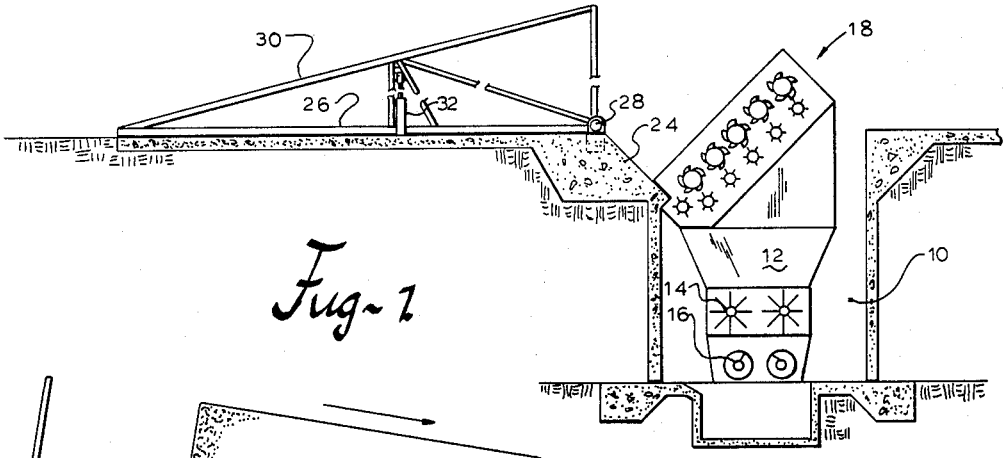
FIG. 1 is a schematic representation of a side sectional view of an embodiment of my invention.
Figure 2:
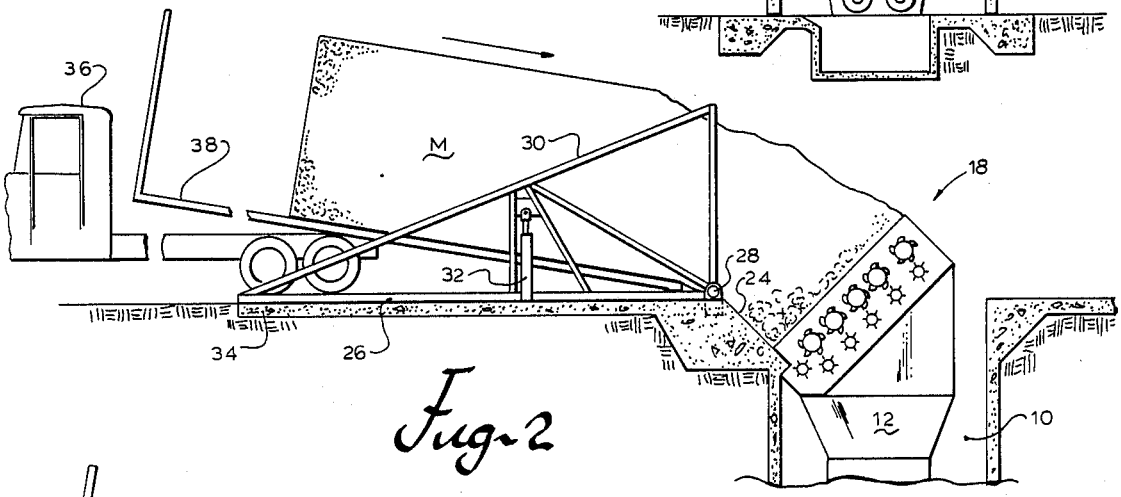
FIG. 2 is similar to FIG. 1 with the addition of a truck unloading cotton onto the short slide.
Figure 3:
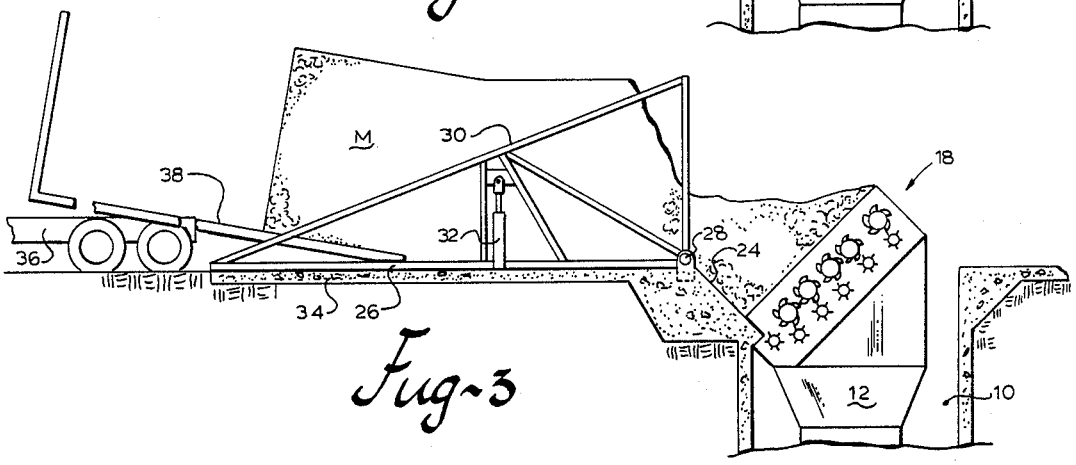
FIG. 3 is similar to FIGS. 1 and 2 wherein the truck is shown discharging the module onto the horizontal deck.
Figure 4:
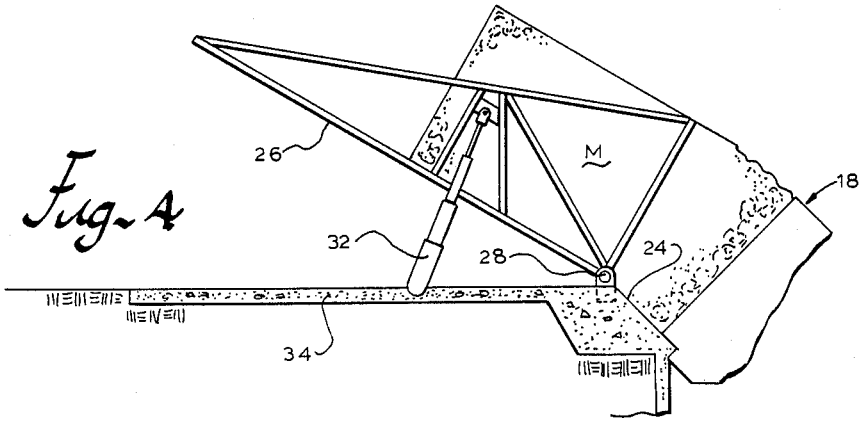
FIG. 4 is similar to FIGS. 1, 2, and 3 wherein the deck is shown tilted to slide the seed cotton on the module onto the short slide and breaker.
Figure 5:
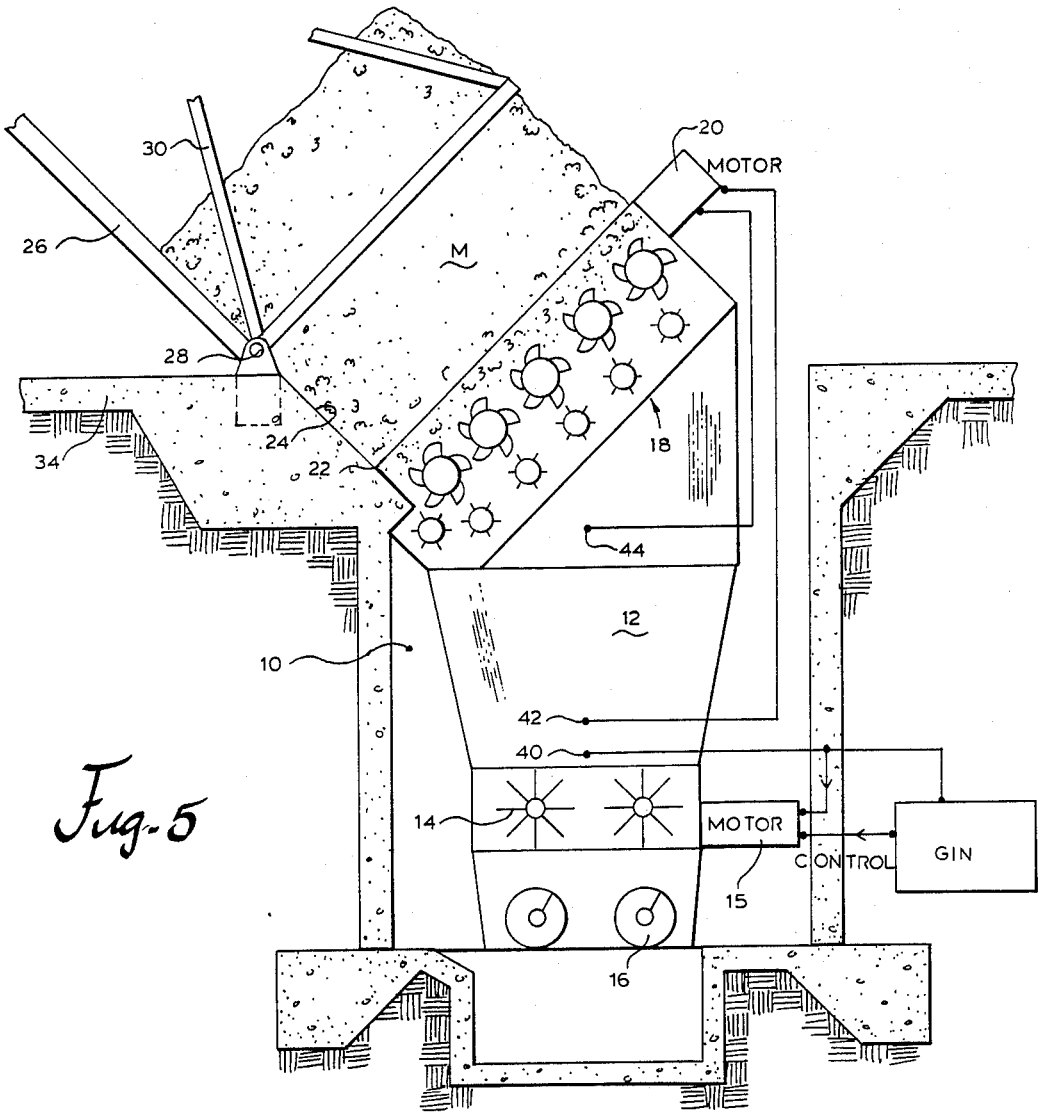
FIG. 5 is a sectional view of the pit and hopper portion drawn to a larger scale than that shown in FIG. 4 with certain controls shown schematically.

Referring to the drawings, there may be seen an embodiment according to this invention. Pit 10 is excavated from the area. Hopper 12 is located in the pit 10. Feeder 14 is located at the bottom of the hopper 12 and driven by feeder electric motor which is schematically shown for conciseness. Conveyor 16 receives the cotton from the feeders 14 and conveys it to the gin. It will be understood that the conveyor 16 is somewhat skematically represented inasmuch as conveyors for this purpose are well-known. For example, see the WILKES ET AL, CONDARCO ET AL, or PRATHER patents identified above.

Breaker or breaker header 18 is near or at the top of the pit 10. The breaker 18 includes a plurality of cylinders to break or move the cotton from the packed module, and discharge it into the hopper 12. Units suitable for this purpose are well-known and are shown in the WILKES ET AL, CONDARCO ET AL, and PRATHER patents, all noted above. It is driven by breaker electric motor 20 schematically represented for conciseness.

From the bottom 22 of the breaker short slide 24 angles upward. Seed cotton placed upon the slide 24 slides into the breaker 18. Therefore, it is necessary that the slide angle upwards sufficiently for cotton to slide along it. The slide is conveniently made of a steel plate. The sand and dust within the cotton will scour the slide so the cotton will slide well upon it and therefore the angle need not be excessively steep.

Deck 26 is pivoted by hinges 28 to the top of the slide 24. The deck 26 has truss 30 along each side. Hydraulic cylinder 32 extends from foundation 34 of the deck 26 to the truss 30 at about midpoint between the ends of the deck 26. Two cylinders 32 are provided, one on each side of the deck.

Therefore, it may be seen that truck 36 with a special module carrying bed 38 (see SCHLITZ patent noted above) can be backed upon the deck 26. With the end of the bed 38 lowered and about even with the hinges 28, the chain of the truck can be actuated without actuating the drive which moves the truck forward. Sufficient seed cotton from the module "M" can be discharged onto the slide 24 so that the space between the hinges 28 and the breaker 18 is full of cotton. Although not specifically shown in the drawings, it would be understood by those skilled in the art that a side could be placed along the slide 24 and the breaker 18 to prevent loose cotton from spilling out. Thus the slide 24 with the sides might be described as a chute to permit the cotton to be guided into the breaker 18.

When this chute or slide 24 is full, then the ground engaging wheels of the truck 36 may be actuated so the truck pulls forward as the remaining portion of the module "M" is laid or placed upon the deck 26. The truck 36 is then pulled free of the deck 26. The deck 26 is then tilted by the hydraulic cylinder 32 which forms a means for tilting the deck 26. The module "M" on the deck will be fed along the slide 24 into the breaker 18. The seed cotton removed by the breaker 18 is thrown into the hopper 12 where it is fed by the feeder 14 to the cotton gin.

As soon as most of the module is fed so that the remnants of the module are all upon the short slide 24, the deck is lowered by the hydraulic cylinders 32 to a horizontal position and another module "M" placed thereon. If possible, additional cotton may be discharged on the slide 24, however, if the slide 24 is full of cotton from the previous module, it will be understood that this part of the dishcarge of the module "M" from the truck 38 would be omitted.

The above procedure would be followed if the successive modules were to be combined in the ginning operation. It would be understood that in present day operation, often several modules owned by the same grower will be ginned successively. In such instance, there is no reason to separate the cotton from one module to the next.

If the succeeding module is owned by a different grower than the previous module, it will be necessary to wait until all of the seed cotton is broken from the slide 24 by the breaker 18 and thrown into the hopper 12 before an additional seed cottom from a module is put on the slide 24. As soon as all of the seed cotton is cleared from the slide 24, the electric breaker motor 20 driving the breaker 18 may be manually stopped so that the breaker no longer feeds cotton into the hopper 12. Then a module can be placed, partially upon the slide 24 and partially upon the deck 26 as described above. In such a case, the breaker motor 20 would not be restarted until the hopper 12 is empty of the previous growers seed cotton. As soon as all the previous growers cotton is feed from the hopper 12, then the feeder 14 may be stopped, by stopping the feeder motor 15 manually. At this time, the breaker motor 20 is restarted. Then when the conditions in the cotton gin are such that the cotton between the two growers can be segregated, the hopper motor 20 is restarted manually.

From the above, it may be seen that seed cotton can be supplied from my module feeding system to the cotton gin as required by the cotton gin. I.e. if all of the cotton is by the same grower, there can be a continuous supply of seed cotton to the cotton gin. There may never be an interruption waiting for the placement of another cotton module, inasmuch as the capacity of the slide 24 and the hopper 12 are sufficient to continue the operation of the gin while another module is being placed upon the deck 26.

Those having ordinary skill in the art will recognize that for very high-speed gin operation, an additional breaker, slide, and deck could be placed on the opposite side of the pit 10 from the one described above.

The description to this point has been for a manually operated unit. Preferably the operation would be automatic. The feeder electric motor 15 would be controlled from within the cotton gin dependent upon the need for cotton within the cotton gin. The preferred embodiment is to use a variable speed electric motor for the feeder so that the cotton is fed to the cotton gin at a speed according to the rate which it is needed in the cotton gin.

The hopper 12 would be supplied with three cotton sensors, preferably photo sensitive, electric cells 40, 42, and 44. Empty hopper sensor 40 would be located at the very bottom of the hopper. Low hopper sensor 42 would be located near the bottom of the hopper, but spaced upward from the empty hopper sensor 40. Full hopper sensor 44 would be located at the top of the hopper 12.

If when in operation, the empty hopper sensor 40 showed that the cotton was depleted from the hopper 12, it would shut off the feed motor 15, and activate a signal within the cotton gin to indicate to the personnel there that there was no cotton available. Those skilled in the art would understand that the empty hopper sensor 40 could also be located along the conveyor 16 indicating that there was no cotton being conveyed from the hopper 12, because it was empty.

The low hopper sensor 42 and the full hopper sensor 44 would control the breaker motor 20. If the hopper 12 was full as indicated by the full hopper sensor 44; the breaker motor 20 would be stopped, interrupting the flow of seed cotton into the hopper. If the low hopper sensor 42 indicated that there was no cotton at this point, the breaker motor 20 would be started to drive the breaker 18 to again refill the hopper 12. Therefore, it may be seen that the capacity of the breaker 18 to remove cotton from the module "M" must be greater than the capacity of the feeder 14 to feed cotton from the hopper 12.

Those having ordinary skill in the art will understand how these controls could be wired to control the electric motors 15 and 20. Therefore, these controls have not been shown for conciseness. Of course, as stated above, there would be manual controls, which would be used to override the automatic controls in the special situations identifed above.

The details of the hydraulic cylinders 32 and their controls for raising and lowering the deck 26 have not been shown inasmuch as they are all well-known. Specifically most grain is moved from trucks to pits by tilting a deck carrying the entire truck, thereby sliding the grain within the bed of the truck into conveyors in the pit. This is common commercial practice at grain elevators where grain is received from the growers.

The hydraulic cylinders 32 are tilt means attached to the deck 26 for tilting the deck so that the cotton module placed on the deck while horizontal will slide to the breaker 18.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | |
|---|---|
| 10 pit | 28 hinges |
| 12 hopper | 30 truss |
| 14 feeder | 32 hydraulic cylinder |
| 15 feed motor | 34 foundation |
| 16 conveyor | 36 truck |
| 18 breaker | 38 bed |
| 20 breaker motor | 40 empty hopper sensor |
| 22 bottom of breaker | 42 low hopper sensor |
| 24 slide | 44 full hopper sensor |
| 26 deck | "M"module |

SUBJECT MATTER CLAIMED FOR PROTECTION

I claim as my invention:

1. The method of feeding seed cotton from a module into a gin comprising:

a. placing a module of packed seed cotton upon a horizontal deck,
b. tilting the deck to slide the seed cotton of the module onto a slide,
c. sliding the packed seed cotton on the slide into a breaking header,
d. breaking the packed cotton on the slide, and
e. throwing the broken cotton into a pit, then
f. feeding the broken cotton from the pit, and
g. conveying the cotton to the gin.

2. The invention as defined in claim 1 including all of the limitations a. through g. with the addition of the following limitations:

h. catching the seed cotton in a hopper in the pit as it is thrown from the breaking header,
i. breaking and throwing the cotton responsive to the amount of seed cotton in the hopper, and
j. feeding the seed cotton from the hopper in the pit responsive to the need for cotton within the gin.

3. The method of feeding seed cotton packed into a module on a bed of a truck into a gin comprising:

a. backing the truck with the module upon a horizontal deck,
b. lowering the end of the bed,
c. placing the module of packed seed cotton from the bed onto the horizontal deck,
d. tilting the deck to
e. slide the module of packed seed cotton into a breaking header, which
f. breaks the packed seed cotton from the module and
g. throws it into a pit, then
h. feeding the seed cotton from the pit, and
i. conveying the seed cotton to the gin.

4. The method as defined in claim 3 including all of the limitations a. through i. with the addition of the following limitations:

j. catching the seed cotton in a hopper in the pit as it is thrown from the breaking header,
k. breaking and throwing the seed cotton responsive to the amount of seed cotton in the hopper, and
l. feeding the seed cotton from the hopper in the pit responsive to the need for cotton within the gin.

* * * * *